United States Patent [19]

Taira

[11] Patent Number: 4,773,185

[45] Date of Patent: Sep. 27, 1988

[54] SURFACE ABRADING MACHINE

[75] Inventor: Yasunori Taira, Saitama, Japan

[73] Assignee: Linden Integral Research, Inc., Tokyo, Japan

[21] Appl. No.: 9,807

[22] Filed: Feb. 2, 1987

[30] Foreign Application Priority Data

Jan. 31, 1986 [JP] Japan ..... 61-19768

[51] Int. Cl.[4] ..... B24B 37/04

[52] U.S. Cl. ..... 51/118; 51/133

[58] Field of Search ..... 51/133, 120, 119, 118, 51/117, 131.3, 131.1

[56] References Cited

U.S. PATENT DOCUMENTS

| | | | |
|---|---|---|---|
| 2,238,859 | 4/1941 | Indge | 51/120 |
| 2,709,321 | 5/1955 | Indge | 51/118 |
| 3,105,328 | 10/1963 | Torres | 51/120 |
| 3,813,828 | 6/1974 | Bennett | 51/133 |
| 3,925,936 | 12/1975 | Orlov et al. | 51/120 |
| 4,205,489 | 6/1980 | Orlov et al. | 51/118 |
| 4,593,495 | 6/1986 | Kawakami | 51/131.3 |

FOREIGN PATENT DOCUMENTS

| | | | |
|---|---|---|---|
| 0757308 | 8/1980 | U.S.S.R. | 51/131.3 |

OTHER PUBLICATIONS

Planetary "Free" Wafer Polishing, Goetz et al., IBM Technical Dislcosure Bulletin, vol. 15, No. 6, 11-1972.

*Primary Examiner*—Frederick R. Schmidt
*Assistant Examiner*—Robert A. Rose
*Attorney, Agent, or Firm*—Oblon, Fisher, Spivak, McClelland & Maier

[57] ABSTRACT

Surface abrading machines such as lapping machines of the type that lap both surfaces of the works, such as semiconductor wafers, using an upper lap and a lower lap between which such works are positioned by means of holders. The design object is to enhance the accuracy of lapping by reducing to a minimum the rotation of holders, thereby reducing the speed difference at different points of the holders and, therefore, the works carried thereby. When a central gear 18, which constitutes a work holding mechanism, is moved by the rotation of an eccentric cam 15 mounted over a drive shaft 3, an internal gear 28 supported inside a support ring, which is a pin gear 27, like a differential gear revolves at a low speed along the support ring 27 while being moved like the central gear 18 through the holders 30 placed between and engaged with the internal gear 28 and the central gear 18. The rotating speeds of the central gear 18 and the holders 30 are so slow that the speed difference at different points of the rotating holders is kept to a minimum, as a result of which the works are lapped by the upper and lower laps 10 and 20 under substantially uniform conditions and, therefore, with a higher degree of accuracy.

7 Claims, 4 Drawing Sheets

SURFACE ABRADING MACHINE

BACKGROUND OF THE INVENTION

1. Field of the Invention

This invention relates to surface abrading machines, and more particularly to such surface abrading machines as lapping machines that are used for precision-finishing the surfaces of such works as semi-conductor wafers.

2. Description of the Prior Art

The working principle of lapping machines is to directly transfer the flatness of an upper and a lower lap to the surfaces of the work held therebetween using abrasive particles (lapping material). Accordingly, their working accuracy depends on the following three factors:

(1) Smoothness of the upper and lower laps;

(2) Kind and characteristics (including the method of use) of abrasive particles; and (3) Difference in the length of orbit (peripheral speed) at different points of the work resulting from the relative motion of the laps and holder.

When the upper and lower laps are smooth enough and abrasive particles of the type optimum for the quality of the work and the required working accuracy are used (i.e., when the aforementioned requirements (1) and (2) for the soft lap surface are satisfied), the composite peripheral speed and the length of orbit at different points of the work, which result from the relative motion of the laps and holder, must be made uniform to improve working accuracy.

In lapping machines of known types, a plurality of holders are engaged with a sun gear at the center and surrounding internal gears in a sun-and-planet fashion, with the works held by the holders being abraded by an upper and a lower lap. Two-way lapping by such lapping machine is performed by rotating the sun and internal gears while stopping the upper and lower laps, thereby causing the holders to rotate on their own axes and revolve around the sun gear like planets. Four-way lapping, on the other hand, is performed by moving the sun and internal gears and the upper and lower lap simultaneously.

In doing lapping, the center of a holder that moves like a planet draws a truly circular orbit around the sun gear, with other points than the center on the holder drawing orbit longer than the one at the center because of the motion associated with the rotation of the holder on its own axis. In other words, the center of the holder draws the shortest orbit, while other points on the holder draw longer orbits, the length of the orbit drawn by each of such other points being proportional to the distance of the point from the center. Consequently, the speed with which the work on the holder is lapped becomes nonuniform in some portions, with a resulting drop in working accuracy.

With this type of lapping machine, the size of laps is such that the ratio of outside diameter to inside diameter is 2.5 to 3 (outside diameter/inside diameter=2.5 to 3). Accordingly, the peripheral speed on the outside is 2.5 to 3 times faster than that on the inside. In four-way lapping, this speed difference produces such an effect as to further drop working accuracy.

When the work demands to be finished with a high degree of accuracy, therefore, it is necessary to reduce the influence of such speed difference to a minimum.

OBJECTS OF THE INVENTION

An object of this invention is to provide a high-precision surface abrading machine that reduces to a minimum the speed difference at difference parts thereof by minimizing the rotation of the holders during lapping, thereby avoiding a drop in working accuracy that might result if such speed differences existed.

Another object of this invention is to provide a surface abrading machine equipped with simple driving means to surely move the holders at a low rotating speed.

SUMMARY OF THE INVENTION

The above objects of this invention are achieved by a surface abrading machine which comprises an upper and a lower lap adapted to abrade both surfaces of the work held therebetween, a drive shaft disposed at the center of said two laps and having an eccentric cam fitted therearound, a support ring concentrically disposed around said two laps, and work holding means supported inside said support ring like a differential gear, brought in contact with said eccentric cam in a hole provided at the center thereof so that rotation of the eccentric cam causes the work holding means to revolve along the support ring at a low speed while moving in the radial direction.

In a surface abrading machine of the type just described, when the eccentric cam on the drive shaft rotates, the work holding means supported inside the support ring like a differential gear is thereby caused to move radially and, at the same time, revolve along the support ring at a low speed.

The revolving speed of the work holding means is so low that the speed difference at different parts of the revolving work holding means is minimal, whereby the work held thereby is lapped by the upper and lower laps under substantially uniform conditions. The result is an improvement in working accuracy.

DETAILED DESCRIPTION OF THE PREFERRED EMBODIMENTS

Figure 1:
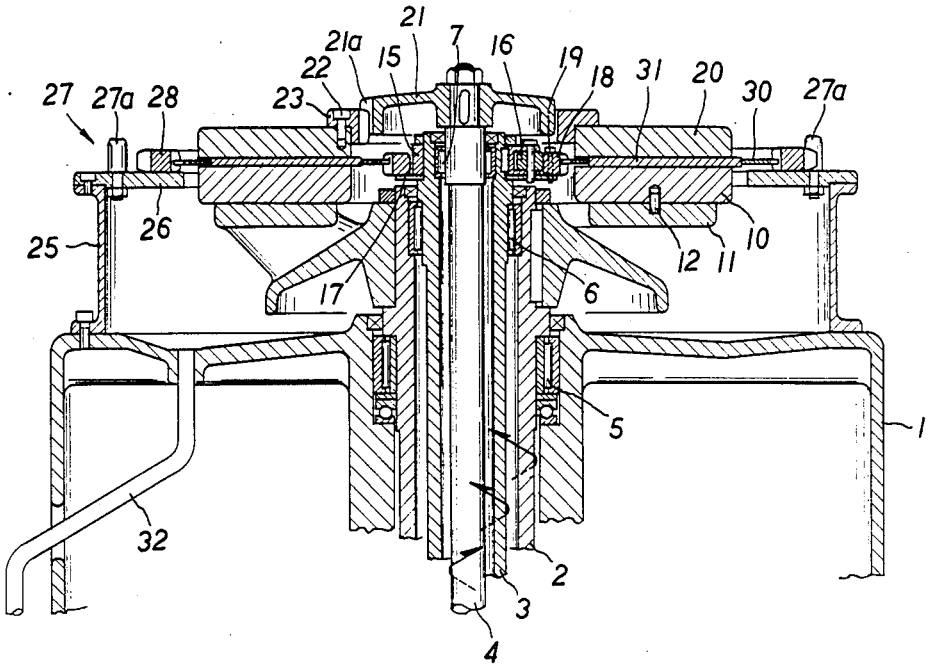
FIG. 1 is a cross-sectional view showing the principal part of a first preferred embodiment of this invention.

Now lapping machines embodying the principle of the surface abrading machines of this invention will be described in detail.

Lapping machines shown in the drawings are adapted to use holders of two different sizes as desired. A plurality of small-diameter holders are used in preferred embodiments shown in FIGS. 1 to 4, while a single large-diameter holder is used in a preferred embodiment shown in FIGS. 5 and 6.

THE FIRST EMBODIMENT

Figure 2:
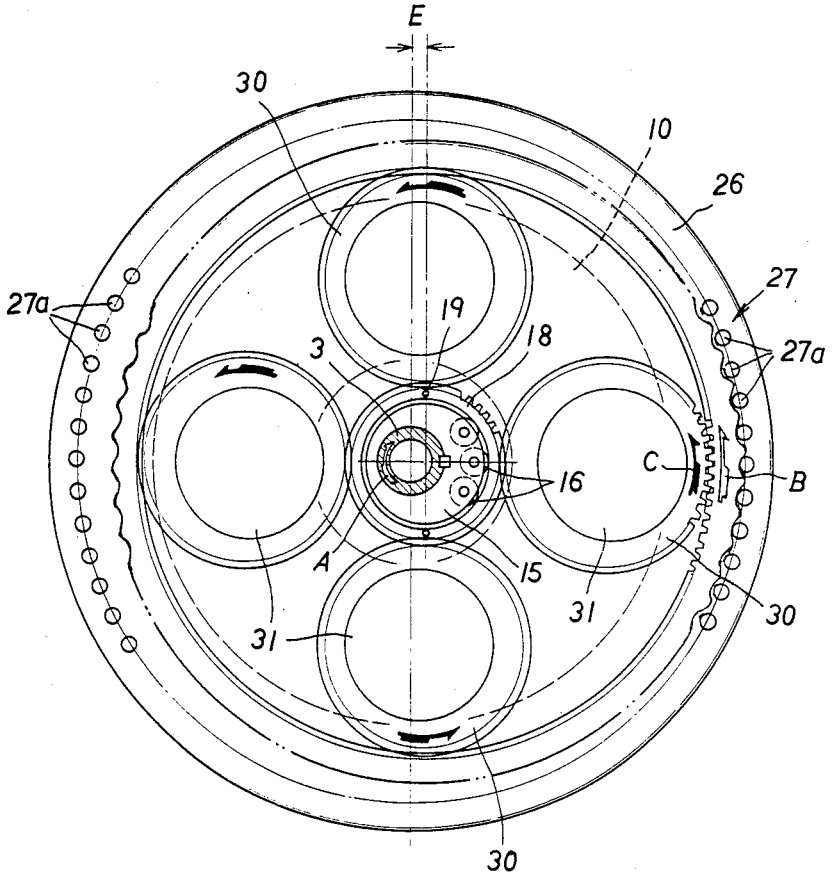
FIG. 2 is a plan view of the same embodiment, with an upper lap thereof removed.

At the center of the body 1 of a lapping machine shown in FIGS. 1 and 2, a first, a second and a third drive shaft 2, 3 and 4, which are connected to a drive source not shown, are disposed concentrically and in an independently rotatable manner, with bearings 5 to 7 interposed therebetween. A lap receiver 11 is mounted at the top end of the first drive shaft 2, with an annular lower lap 10 being fastened on the lap receiver 11 with pins 12. An eccentric cam 15 having a contact portion consisting of rollers 16 and an eccentric receiver 17 are fastened to the top end of the second drive shaft 3. A central gear 18 mounted on the eccentric receiver 17 is detachably fitted over the eccentric cam 15, with the central gear 18 being detachably engaged with the eccentric receiver 17 by means of pins 19. An engaging member 21 having a claw 21*a* is mounted at the top end of the third drive shaft 4, with the claw 21*a* on the engaging member 21 being adapted to come in and out of engagement with another engaging member 23 fastened to an annular upper lap 20 with a bolt 22. The third drive shaft 4 drives the annular upper lap 20 through the engaging members 21 and 23. The annular upper lap 20 and the annular lower lap 10 are of substantially equal size.

A cylindrical frame 25, which serves also as a cover, is erected on the body 1 in such a manner as to surround the drive shafts 2 to 4, with an annular base plate 26 mounted at the top end of the cylindrical frame 25. A number of pins 27*a* are planted on the base plate 26 at regular intervals in such a manner as to concentrically surround the annular upper and lower laps 10 and 20, thereby constituting a pin gear 27. An internal gear 28 which has teeth, which are somewhat smaller in number than those on the pin gear 27, formed on the outer circumference thereof is mounted rotatably and in a radially movable manner. The outer teeth of the internal gear 28 are meshed with the pin gear 27 like a differential gear. The internal gear 28 is also detachable like the central gear 18.

A plurality of holders 30 are engaged with the central gear 18 and the internal gear 28 like planetary gears. Each holder 30 is adapted to hold a work 31 in position.

Reference numeral 32 in FIG. 1 designates a pipe through which abrasive particles are discharged.

In a lapping machine of the type just described, the central gear 18 is set free with respect to the second drive shaft 3 when the pins 19 are removed. When the second drive shaft 3 is rotated in the direction of arrow A, in FIG. 2 the central gear 18 is moved radially by the action of the eccentric cam 15, whereby the internal gear 28 is also moved likewise through the holders 30. Engaged with the pin gear 27 like a differential gear, the internal gear 28 rotates in the direction of arrow B at a low speed resulting from the difference in the number of teeth on the internal gear 28 and the pin gear 27, whereby the holders 30 also rotate in the direction of arrow C at a low speed while moving in the direction of the radius of the laps to cause the works 31 held thereby to be abraded by the annular upper and lower laps 10 and 20.

The number of rotations of each holder 30 varies with the resistance offered as a result of the engagement of the central gear 18 with the internal gear 28, the lapping of the associated work 31 by the annular upper and lower laps 10 and 20, and so on. At any rate, the rotating speed of each holder 30 is so low that the speed difference at different points of the rotating holder 30 is kept to a minimum, thereby permitting the work associated 31 to be abraded by the annular upper and lower laps 10 and so under substantially uniform conditions.

The relationship between the number of rotation N of the internal gear 28 and the number of rotation n of the second drive shaft 3 is expressed as follows:

$$N = \frac{Z_1 - Z_0}{Z_0} \times n$$

where $Z_1$ = the number of pins on the pin gear $Z_0$ = the number of teeth on the internal gear Because $Z_1 - Z_0$ is a small value relative to $Z_0$, the number of rotation N of the internal gear 28 is very small compared with the number of rotation n of the drive shaft 3. If, for example, $Z_1 = 64$, $Z_0 = 60$ and $n = 60$ rpm, $N = 4$ rpm.

Consequently, the holders 30 are rotated at a very low speed by the rotating internal gear 28. In two-way lapping, in which the annular upper and lower laps 10 and 20 are kept at a standstill, the entire surfaces of the works 31 held by the holders 30 are substantially uniformly abraded by the annular upper and lower laps 10 and 20 with a momentum of $2E \times n$.

In four-way lapping, in which the annular upper and lower laps 10 and 20 are also simultaneously rotated, the invluence of the rotation of the holders 30 is almost completely eliminated, whereby working accuracy is improved over the conventional operation in which the holders move like planets at a high speed.

When the central gear 18 is fastened to the eccentric receiver 17 with pins 19, the holders 30 are allowed to make a constant planetary motion. In this case, the holders 30 are caused to move radially, whereby the work is abraded by the laps more uniformly than in the conventional operation in which no such radial motion is involved and, therefore, is finished with a higher degree of accuracy.

THE SECOND EMBODIMENT

Figure 3:
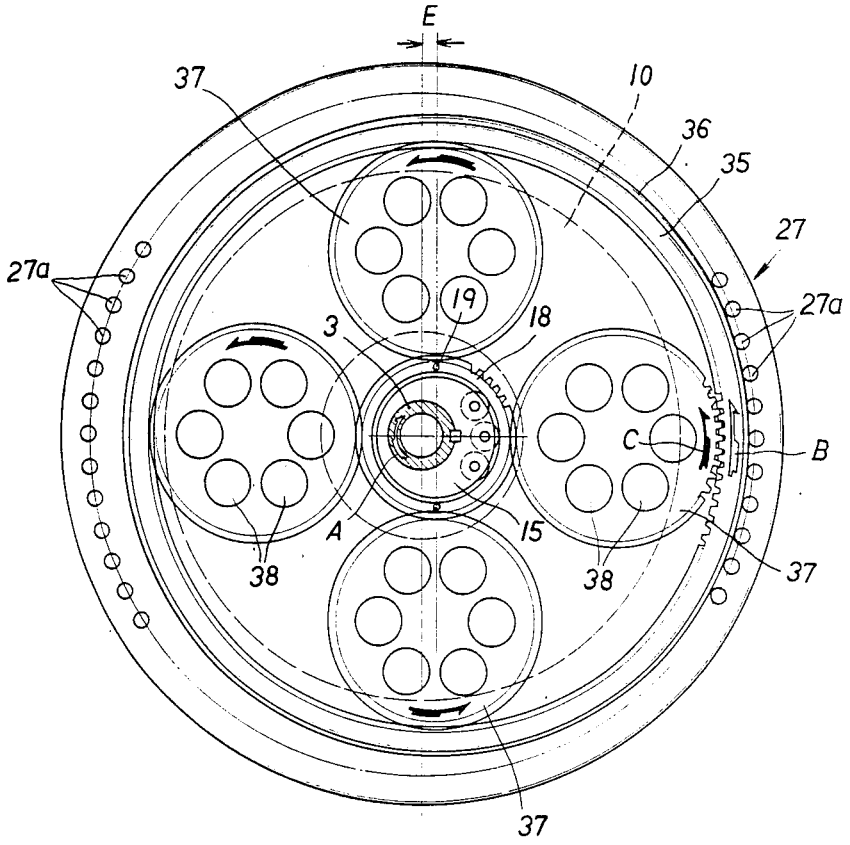
FIG. 3 is a plan view of a second preferred embodiment of this invention, with an upper lap thereof removed.
Figure 4:
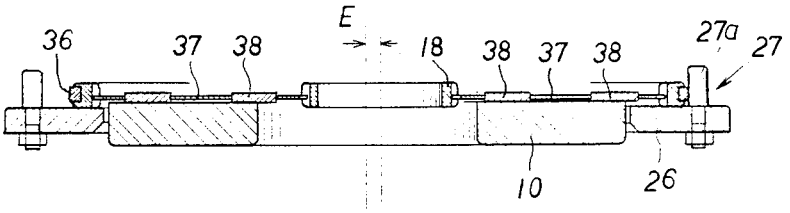
FIG. 4 is a partial cross-sectional side view of the second embodiment.

FIGS. 3 and 4 show a second embodiment in which an internal gear 35, which is not brought into engagement with the pin gear 27, has a contact portion made up of an elastic member 36 of such material as polyurethane and synthetic rubber on the outer circumference thereof. The contact portion is brought in contact with the inner circumference of the pin gear 27. Each one of a plurality of holders 37 engaged with the internal gear 35 holds a plurality of smaller-diameter works 38. In this embodiment, the pin gear 27 may be replaced with a cylindrical member. That is, the pin gear 27 functions as a support ring that supports the internal gear 35 that is internally held in contact therewith like a differential gear.

In this embodiment too, as in the preceding one, the internal gear 35 rotates at a low speed resulting from the diameter difference from the pin gear 27 while moving radially.

THE THIRD EMBODIMENT

Figure 5:
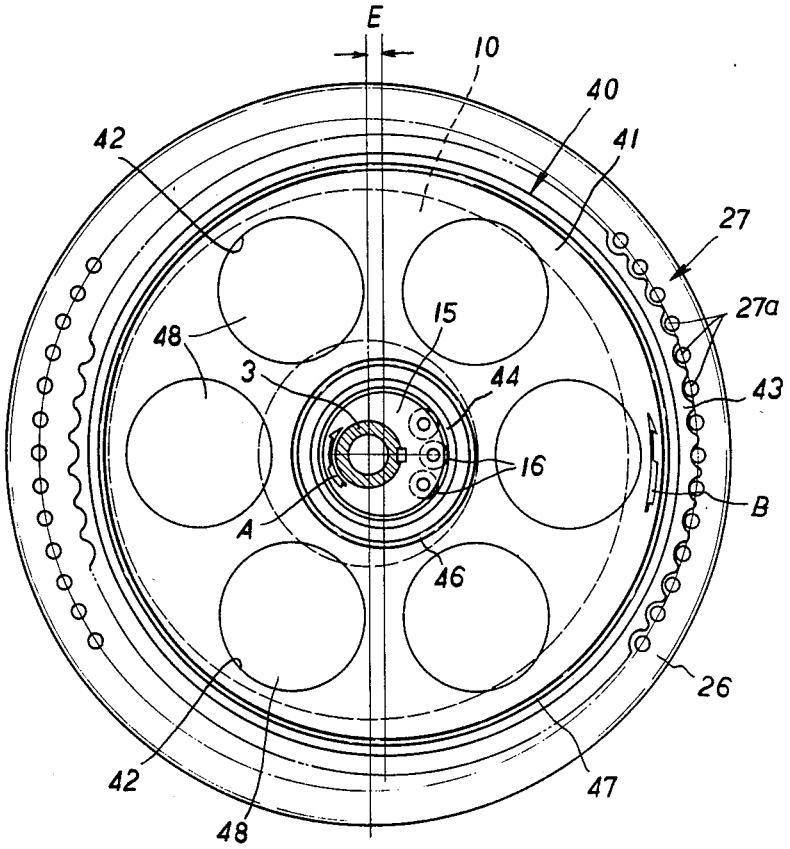
FIG. 5 is a plan view of a third preferred embodiment of this invention, with an upper lap thereof removed.
Figure 6:
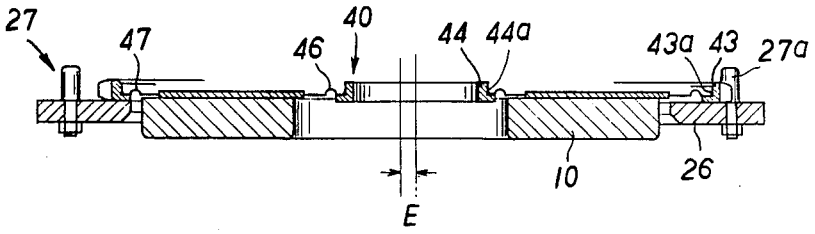
FIG. 6 is a partial cross-sectional side view of the third embodiment.

FIGS. 5 and 6 show a third preferred embodiment in which a single large-diameter holder 40 is used in place of the smaller-diameter holders used in the preceding embodiments. In this embodiment, the central gear 18 and the internal gear 28 are removed, while the large-diameter holder 40 is set instead. Substantially, this embodiment is similar to the one shown in FIG. 2, except in that the central gear 18, the internal gear 18, and the holders 30 that constitute work holding means are now integrated into a single large-diameter holder 40.

The holder 40 is suited for lapping such extra-thin works as semiconductor wafers.

An annular holder proper 41 of thin metal sheet, such as steel sheet, which is larger in diameter than the annular upper and lower laps 10 and 20, has a plurality of work-holding holes 42 punched therethrough. An annular gear 43, which has such a number of teeth as are slightly fewer than the pins on the pin gear 27, is fitted on the outer circumference of the holder proper 41 in such a manner as not to overlap the abrading surfaces of the annular upper and lower laps 10 and 20. An inner ring 44 is fitted on the inner circumference of the holder proper 41, or the periphery of the center hole provided therein, in such a manner as not to overlap the abrading surfaces of the annular upper and lower laps 10 and 20. The annular holder proper 41 is joined to the annular gear 43 and the inner ring 44 by engaging the inner and outer edges of the annular holder proper 41 with steps 43*a* and 44*a* on the annular gear 43 and the inner ring 44, respectively with spot welding given at several points thereon. To remove the resulting welding strain and the working strain that results when the work holding holes 42 are punched, ribs 46 and 47 are press-formed along the inner and outer circumferences of the annular holder proper 41 so as to project upward when the annular gear 43 and the inner ring 44 are installed. The projecting ribs 46 and 47 not only maintain the desired tension and flatness of the annular holder proper 41 by releasing the strains, but also impart appropriate rigidity to the annular holder proper 41, which becomes increasingly flexible with a decrease in thickness and, at the same time, prevent the abrasive particles supplied to the lapping area from escaping inward and outward.

The large-diameter holder 40 is brought into engagement with the pin gear 27 like a differential gear by means of the annular gear 43 mounted on the annular base plate 26 and set on the annular lower lap 10, with the rollers 16 on the eccentric cam 15 kept in contact with the inner ring 44. Works 48 to be lapped are fitted in the work-holding holes 42. The large-diameter holder 40 deviates from the center of the annular upper and lower laps 10 and 20 by the amount of eccentricity E.

When the eccentric cam 15 is rotated by rotating the second drive shaft 3 in the direction of arrow A in this embodiment, as in the first embodiment, the large-diameter holder 40 is radially pushed by the rollers 16 on the eccentric cam 15, thereby moving within the range of 2E while changing the engaging point with the pin gear 27 and rotating in the direction of arrow B at a speed established by the difference in the number of pins 27*d* on the pin gear 27 and the number of teeth on the annular gear 43. Accordingly, both surfaces of the works 48 held in the large-diameter holder 40 are abraded by the annular upper and lower laps 10 and 20 while revolving about the second drive shaft 3.

Abrasive particles supplied to the lapping area when lapping is carried out are stopped by the ribs 46 and 47 on the large-diameter holder 40, thus being steadily fed to the annular upper and lower laps 10 and 20, at the same time, and prevented from flowing into the engaging area of the pin gear 27 and the annular gear 43 and the contacting area of the eccentric cam 15 and the inner ring 44. This keeps various parts of the lapping machine from getting abraded away by the abrasive particles. In addition, the ribs 46 and 47 maintain the desired tension and flatness of the large-diameter holder 40, impart additional rigidity thereto, and enhance the serviceability and durability thereof.

In an experiment on the lapping of works 48 to 100 μm in thickness, surface abrading machines of this invention produced much better results than conventional lapping machines in which holders make a planetary motion.

What is claimed is:

1. A surface abrading machine which comprises:

(a) an upper lap and a lower lap for lapping both surfaces of works to be held therebetween;

(b) a drive shaft disposed at the center of said laps, said drive shaft having an eccentric cam fitted therearound;

(c) a central gear provided around said eccentric cam and detachably engaged with said drive shaft through said eccentric cam, said central gear being rotated integrally with said eccentric cam when said central gear is engaged with said drive shaft and being radially moved with said eccentric cam when disengaged from said drive shaft;

(d) a support ring disposed around said laps concentrically, said support ring comprising a pin gear which is comprised of a number of pins disposed annularly on said support ring;

(e) an internal gear the outside of which engages with said pin gear of said support ring and which is rotated along with said pin gear; and (f) a plural number of holders disposed between said internal gear and said central gear, said holders being engaged with said internal and central gears.

2. A surface abrading machine which comprises:

(a) an annular upper and an annular lower lap that, in use, lap both surfaces of one or more works held therebetween, said annular upper and lower laps having a center;

(b) a drive shaft disposed at the center of said annular upper and lower laps, said drive shaft having an eccentric cam fitted therearound;

(c) a stationary support ring disposed concentrically around said annular upper and lower laps; and (d) work holding means supported inside said stationary support ring, said work holding means comprising:

(i) a central gear fitted over said eccentric cam;

(ii) an internal gear supported inside said stationary support ring for movement relative to said stationary support ring, said internal gear having an outer surface in meshing engagement with said stationary support ring; and (iii) a plurality of holders held between and engaged with said central and internal gears.

3. A surface abrading machine according to claim 2, in which said central gear is detachably engaged with said drive shaft.

4. A surface abrading machine which comprises:

(a) an annular upper lap and an annular lower lap that, in use, lap both surfaces of one or more works held therebetween, said annular upper and lower laps having a center;

(b) a drive shaft disposed at the center of said annular upper and lower laps, said drive shaft having an eccentric cam fitted therearound;

(c) a stationary support ring disposed concentrically around said annular upper and lower laps; and (d) work holding means supported inside said stationary support ring and brought into contact with said eccentric cam in a hole that is provided at the center of said work holding means; and (e) means for causing said work holding means to revolve at a low speed along said support ring while being moved radially by the rotation of said eccentric cam, (f) wherein said stationary support ring comprises a pin gear.

5. A surface abrading machine according to claim 4, in which said work holding means has a peripheral gear portion on the outer circumference thereof, said peripheral gear portion being brought into engagement with said pin gear.

6. A surface abrading machine according to claim 2, in which the portion of said eccentric cam coming in contact with said work holding means comprises rollers.

7. A surface abrading machine according to claim 3, in which the portion of said eccentric cam coming into contact with said work holding means comprises rollers.

* * * * *